US006980105B2

(12) United States Patent
Hodgen

(10) Patent No.: US 6,980,105 B2
(45) Date of Patent: Dec. 27, 2005

(54) ALARM SYSTEM AND METHOD

(76) Inventor: Todd Robert Hodgen, 3808 209th Pl. SE., Bothell, WA (US) 98021

( * ) Notice: Subject to any disclaimer, the term of this patent is extended or adjusted under 35 U.S.C. 154(b) by 87 days.

(21) Appl. No.: 10/833,415

(22) Filed: Apr. 28, 2004

(65) Prior Publication Data

US 2004/0217870 A1 Nov. 4, 2004

Related U.S. Application Data

(60) Provisional application No. 60/466,335, filed on Apr. 29, 2003.

(51) Int. Cl.[7] ..... G08B 1/08

(52) U.S. Cl. ..... 340/539.11; 340/426; 340/430; 340/825.69; 340/825.44; 307/10.2; 307/10.3; 307/10.4; 307/10.5

(58) Field of Search ..... 340/539.11, 426, 340/430, 825.44, 825.69; 307/10.2, 10.3, 307/10.4, 10.5

(56) References Cited

U.S. PATENT DOCUMENTS

| | | | | |
|---|---|---|---|---|
| 3,668,526 A | | 6/1972 | Raskin | |
| 4,884,060 A | * | 11/1989 | Shapiro | 340/514 |
| 4,998,095 A | * | 3/1991 | Shields | 340/574 |
| 5,349,340 A | | 9/1994 | Blumenthal | |
| 5,578,989 A | * | 11/1996 | Pedtke | 340/539.11 |
| 6,181,238 B1 | * | 1/2001 | Garrett et al. | 340/426.17 |
| 6,310,539 B1 | | 10/2001 | Rye | |
| 2003/0067392 A1 | | 4/2003 | Monroe | |
| 2003/0231115 A1 | | 12/2003 | Stanners | |

FOREIGN PATENT DOCUMENTS

| | | |
|---|---|---|
| GB | 2227344 | 7/1990 |

* cited by examiner

*Primary Examiner*—Daniel Wu
*Assistant Examiner*—Tai T. Nguyen
(74) *Attorney, Agent, or Firm*—Polly L. Oliver

(57) ABSTRACT

In an integrated system of alarm components used in the real estate industry, the product family consists of three primary components: a portable transmitter unit, a vehicle-mounted transceiver unit, and a house-installed receiver unit. The system is intended to enhance the personal safety of real estate professionals who venture into the field, e.g., to show vacant houses to potential buyers.

The transmitter is sized to be handheld, attached with a belt clip, or carried in pocket. When a panic button on the transmitter is depressed, the transmitter sends coded radio frequency signals which will activate either or both of the vehicle-mounted transceiver and the house-installed receiver as well as other system devices within range. When the transceiver is activated, the unit's horn will sound, and the transceiver will in turn transmit a coded radio frequency signal to any one or more identified receiver units sharing the same signal code. The receiver unit also comprises a horn that will sound upon receipt of the correct signal. Additionally, contacts are operated to signal ancillary devices that are interfaced to the unit.

15 Claims, 3 Drawing Sheets

ALARM SYSTEM AND METHOD

RELATED APPLICATION

This application claims priority under 35 U.S.C.119(e) to U.S. provisional application Ser. No. 60/466,335, filed on Apr. 29, 2003.

FIELD OF THE INVENTION

This invention pertains generally to alarm systems and more specifically to an integrated system of alarm components used in the real estate industry to enhance the personal safety of real estate agents.

BACKGROUND OF THE FIELD

Every day in this country real estate agents show houses to potential buyers. Often the house being shown is otherwise empty or vacant, and the real estate agent is alone with the potential buyer. This circumstance puts the real estate agent in a vulnerable position in relation to the potential buyer or buyers. Indeed, there is an increasing number of reports about real estate agents being attacked by such potential buyers—usually in the house being shown.

There is hence a need for a personal alarm system to be worn or carried by real estate agents, which could also be used by others who want the additional safety, e.g., health care workers, social workers. In United Kingdom Patent No. GB222734A, Slater discloses an alarm system comprising a personal transmitting unit and a remote receiving unit with siren, to be placed in the user's vehicle. However, Slater's system does not anticipate a broader system (in which, for instance, the user's vehicle is not close to aid sources) and so is not useful in the instant situation.

In U.S. Patent application 2003/0231115, Stanners et al. disclose a personal alarm system comprising a personal transmitter and a transceiver. Stanners' system, however, is not self-contained. There is no ultimate receiver on the system and therefore no assurance that any distress signal sent from the transmitter will be received or heard at all. Also, Stanners' system is limited to one transmitter and one transceiver. It does not anticipate or allow for a broader system.

SUMMARY OF THE INVENTION

The present invention solves the above-mentioned problems by providing an integrated system of alarm components to be used especially in the real estate industry. The system enhances the personal safety of a real estate agent by providing a temporary house alarm for a house being shown and an immediate link between the real estate agent showing the house and the house alarm of any house on the broader system.

The integrated system of the preferred embodiment comprises three components: a portable, handheld personal transmitter unit to be carried by the real estate agent, said unit including a panic button and various other features, a transceiver unit mounted inside the real estate agent's vehicle including a system horn, and a receiver unit mounted in the house being shown. All three components are tuned to at least one unique encoded electronic radio frequency (RF) signal.

The transmitter unit is sized to be handheld or alternatively clipped onto a belt or carried in a pocket. In the preferred embodiment, the unit generally transmits at least one unique RF signal when the panic button is depressed, with a range of approximately 100–150 meters, which range should be sufficient for the signal to reach the transceiver unit in the real estate agent's vehicle. (Obviously, the range can be increased using conventional means thereof in alternate embodiments.)

In the preferred embodiment, the transmitter unit defines at least four buttons: the panic button, a flashlight button, a test button, and a deactivation/cancel button. Depressing the panic button activates the system and causes the transmitter to send out two separate transmissions—one unique rolling coded RF signal (code to be set by proprietary software) to the transceiver and also one standard system RF signal which can be received by any system device (auto transceiver or home receiver) within range. Depressing the panic button also may activate an integral alarm within the transmitter unit. The flash button is used to activate and deactivate a built-in flashlight, which feature provides a low-level light source that can be used by the real estate agent for opening doors, seeing in dark rooms, etc. The test button can be pressed to confirm operational status of various system components or to verify that the user is within operational range of other system devices. The deactivation/cancel button can be depressed in various combinations with the panic button and test button to transmit deactivation codes throughout the system to cancel the alarm. (The transmitter unit of the preferred embodiment will be provided with various dip switches to allow the user to set this deactivation code.)

The transceiver unit of the preferred embodiment is to be mounted inside the real estate agent's vehicle, preferably near a window or windshield. The transceiver unit may include an optional antenna for increasing the range of receiving RF signals. Receipt of the unique rolling coded RF signal from the transmitter activates the transceiver. Upon activation, the transceiver will sound its own system horn and send the standard system coded RF signal to the system's receiver unit installed in the house. The standard system RF signal can also be received by any system device within the transmit range (including other auto transceiver units installed in other agents' vehicles and other home receiver units installed in other houses being shown). One or more sets of contacts are also transitioned to allow for the interconnection of ancillary devices.

The receiver unit is to be installed in a house that is being shown—into a standard electrical outlet. Obviously if one real estate agent is in charge of showing several houses, then a similarly coded receiver unit can be installed in each house. The receiver unit is designed to be activated by the transceiver in any agent's vehicle by means of the standard system coded RF signal emitted by each transceiver, upon activation. In this way, the real estate agent can show one house in the morning and a second house in the afternoon and continue to have the full benefit of the alarms, regardless of who has placed the units. The system allows that any real estate agent who has the personal transmitter and the auto transceiver units of the broader system can operate any home receiver unit.

A dip switch located on the receiver unit will determine the operational mode of the receiver unit—either local or remote mode. In one switch position, the receiver unit will operate in local mode, meaning that the receiver unit will be activated by either the unique rolling coded RF signal transmitted from the transmitter unit or the standard system coded RF signal transmitted from the auto transceiver unit. In the opposing switch position, the receiver unit will operate in remote mode, meaning that the receiver unit will be activated only when it receives both the unique rolling coded RF signal transmitted from the transmitter unit and the standard system coded RF signal transmitted from the auto transceiver unit mounted in the real estate agent's vehicle.

Like the other components, the receiver unit comprises an integrated horn that will sound upon unit activation. An antenna on the unit can be extended and repositioned to increase the receive range.

DETAILED DESCRIPTION OF THE PREFERRED EMBODIMENT

Figure 1:
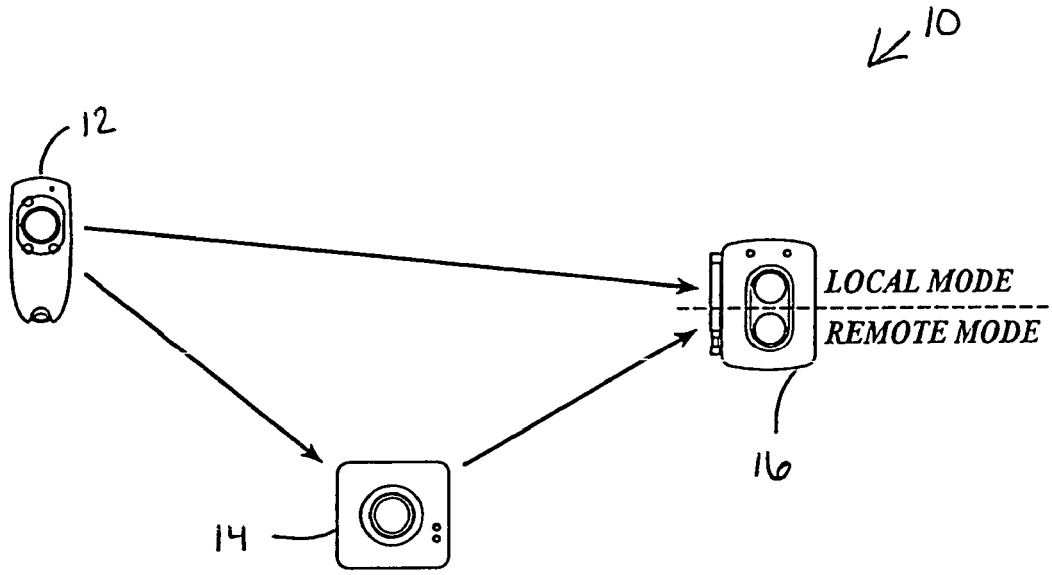
FIG. 1 is a schematic view of the overall system in the preferred embodiment.
Figure 2A:
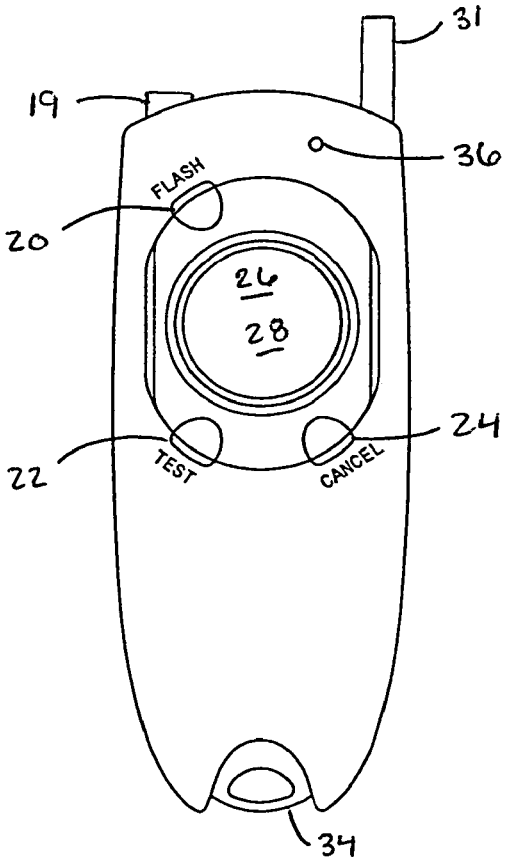
FIGS. 2A and 2B are detail views of one possible embodiment of the transmitter.
Figure 2B:
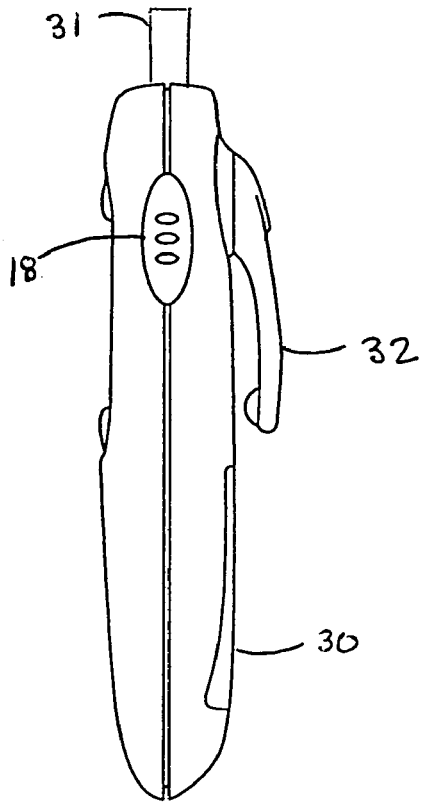

FIG. 1 shows the system 10 as it will be used in the field. A personal transmitter unit 12 is wirelessly linked to and in radio communication with both an auto transceiver unit 14 and a home receiver unit 16. The personal transmitter unit 12 is carried by an agent on the job and may be handheld or clipped to a belt. This transmitter unit 12 comprises a panic button 18 (as seen best in the side view of FIG. 2B), also a flashlight 19 activated by flash button 20, a test button 22, and at least one deactivation/cancel button 24 arranged around a specially designed percussion chamber 26 using piezo technology (piezo device in configuration with the percussion chamber) which is designed for increasing the level of sound of the integral alarm 28 (FIG. 2A). The unit is powered by a battery held within the battery compartment 30. The transmitter unit 12 also includes an antenna 31, an optional belt clip 32 and an optional key ring 34. The LED indicator light 36 flashes when an RF transmission occurs.

Upon activation by the user depressing the panic button 18 (and referring to the arrows in FIG. 1), the transmitter unit 12 transmits a first coded RF signal designed to be received by the auto unit 14. The signal sent is encrypted with a 28-bit key and contains a key code that is maintained as a proprietary trade secret. This key code (sometimes referred to as a "rolling code") is used to ensure a unique signal between the transmitter unit 12 and the auto transceiver unit 14. The transmitter unit 12 also may transmit a second standard system coded RF signal which is commonly acknowledged by all units on the broader proprietary system (auto transceivers and home receivers) and allows for the activation of any proprietary device in the immediate area. Depressing the panic button may also activate the transmitter unit's integral alarm 28.

Figure 3:
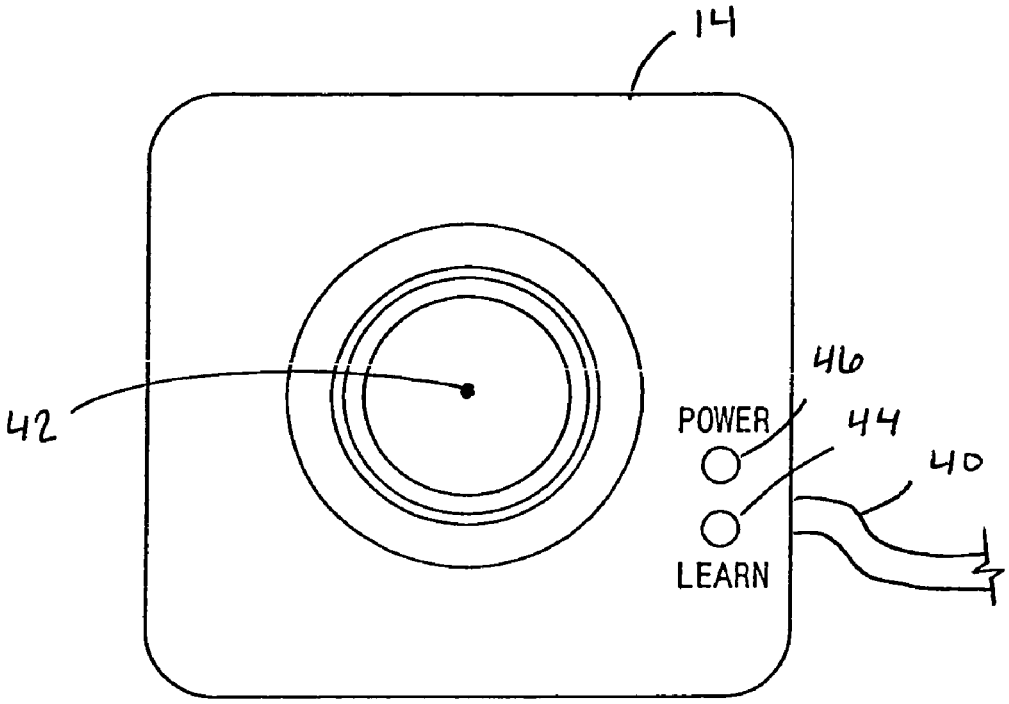
FIG. 3 is a detail view of one embodiment of the receiver.

The auto transceiver unit 14 of FIG. 3 should be installed professionally in an agent's car or other vehicle, with the cable 40 (containing the necessary wires) leading to the car's electrical system, to the separate system horn (not shown), and to the antenna (not shown). This unit 14 receives the first rolling coded RF signal from the transmitter unit 12, activates its separate horn, and in turn transmits the standard system coded RF signal to any home units 16 within range, the receipt of which activates their alarms. Receipt of the transmission from the transmitter unit 12 also raises contacts for ancillary connections (e.g., car horn, GPS, or telematics device) and activates the auto unit's own alarm signal. The auto transceiver unit comprises a learn button 42 with software to allow the unit to recognize and "memorize" the specific rolling code from the transmitter unit, a learn light 44, and a power indicator light 46.

Figure 4:
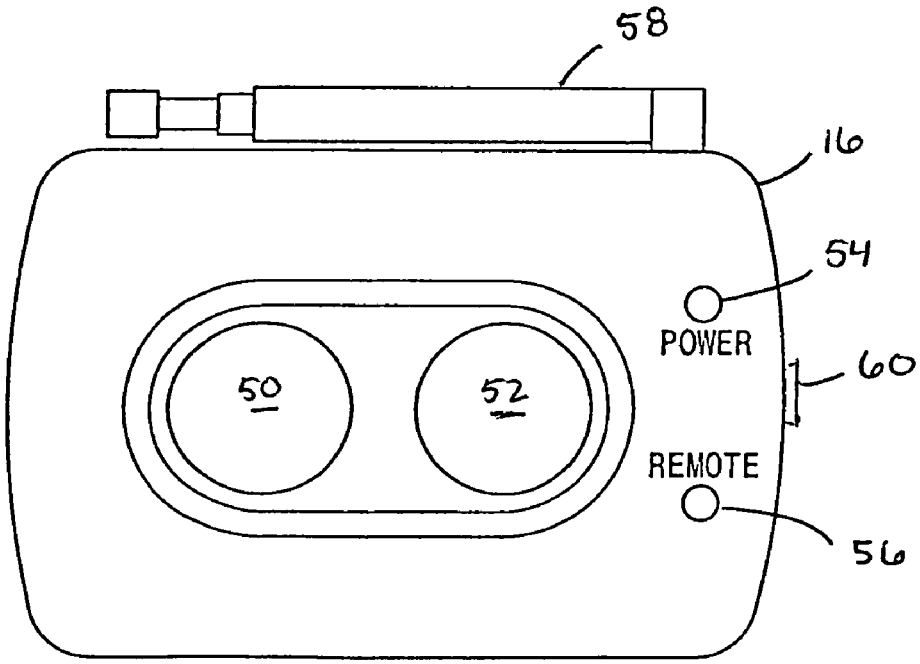
FIG. 4 is a detail view of one embodiment of the transceiver.

The home receiver unit 16 of FIG. 4 is plugged into an appropriate electrical outlet in a home being shown. It comprises two integral alarms 50 and 52, with their respective percussion chambers and piezo devices, a power indicator light 54, and a remote indicator light 56. It also includes an antenna 58. The receiver receives its signal from either or both of the transmitter unit 12 and the auto transceiver unit 14, depending on its mode of operation. The local/remote mode switch 60 toggles between local mode and remote mode. In local mode it relies on either the transmitter or the transceiver for its alarm activation. In remote mode, it relies on both the transmitter and the transceiver for its alarm activation. The remote mode indicator light 56 will denote when the unit is in remote mode.

Figure 5A:
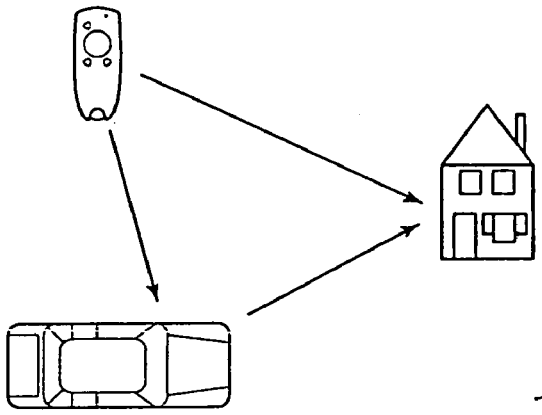
FIG. 5A is a schematic view representing operational configuration A.
Figure 5B:
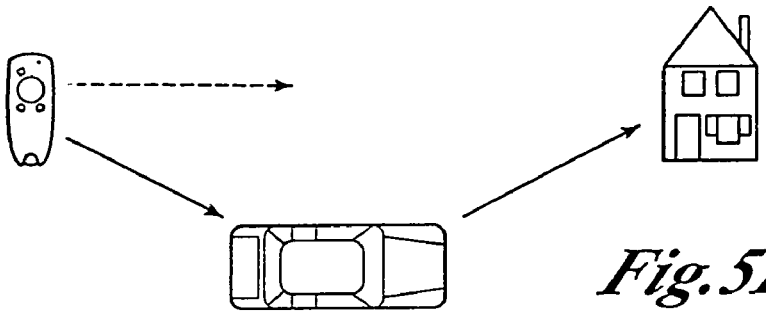
FIG. 5B is a schematic view representing operational configuration B.
Figure 5C:
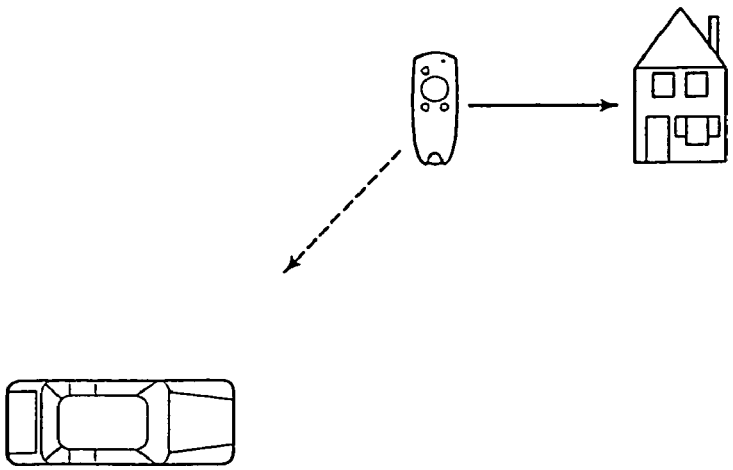
FIG. 5C is a schematic view representing operational configuration C.

FIGS. 5A, 5B, and 5C describe various configurations in which the three primary units may be in physical relation to one another. FIG. 5A depicts the instance in which both the personal transmitter 12 and the vehicle-mounted auto transceiver 14 are within range of the house-installed receiver 16. If the receiver is in local mode, then a user depressing the panic button of the transmitter will activate both the car alarm and the house alarm. Likewise, if the receiver is in remote mode, then a user depressing the panic button of the transmitter will activate both the car alarm and the house alarm.

FIG. 5B depicts the instance in which the handset of the personal transmitter is within range of the transceiver but out of range of the receiver, and the transceiver is within range of the receiver. If the receiver is in local mode, then a user depressing the panic button of the transmitter will activate both the car alarm and the house alarm. However, if the receiver is in remote mode, then a user depressing the panic button of the transmitter will activate the car alarm but not the house alarm.

FIG. 5C depicts the instance in which the personal transmitter is out of range of the car, but within range of the house, and the car is also out of range of the house-installed receiver unit. If the receiver is in local mode, then when the user depresses the panic button, the car alarm will not sound, but the house alarm will sound. If the receiver is set in remote mode, then when the user depresses the panic button, neither the car alarm nor the house alarm will sound.

What is claimed is:

1. A personal alarm system comprising:

A personal transmitter unit to be carried by a user, comprising a panic button, a flashlight with flash button, a test button, and at least one deactivation button, said buttons being arranged around an integral alarm comprising percussion chamber with piezo device;

An auto transceiver unit installed in a user'vehicle connected wirelessly to the transmitter unit by a uniquely coded radio frequency signal, said transceiver unit including a cable containing a plurality of electrical wires for connecting the unit to the vehicle's electrical system; and A plurality of home receiver units connected wirelessly to the auto transceiver by a standard system coded radio frequency signal, each of said receiver units being installed into a standard electrical outlet in a house and comprising at least one integral alarm comprising a percussion chamber with piezo device wherein said home receiver unit further comprises a remote indicator light and a local/remote mode switch capable of setting the receiver unit either local mode or remote mode, wherein said home receiver unit is set in local mode and said integral alarm of said home receiver will be activated only upon receipt either one of the standard system coded radio frequency signals, and wherein said home receiver unit is set in remote mode and said integral alarm of said home receiver unit will be activated only upon receipt of both standard system coded radio frequency signal from the transmitter unit and the transceiver unit.

2. The alarm system of claim 1 wherein the personal transmitter unit further comprises a belt clip.

3. The alarm system of claim 1 wherein the personal transmitter unit further comprises a key ring.

4. The alarm system of claim 1 wherein the auto transceiver unit further includes a horn.

5. The alarm system of claim 1 wherein the auto transceiver unit further includes an antenna.

6. The alarm system of claim 1 wherein the auto transceiver unit further includes ancillary connections.

7. The alarm system of claim 1 wherein the auto transceiver unit further includes a learn button with software to configure the unit to recognize the unique code of the radio frequency signal transmitted from the personal transmitter unit.

8. The alarm system of claim 1 wherein said home receiver units are also wirelessly connected to the transmitter unit by said standard system coded radio frequency signal.

9. A personal alarm system including personal transmitter unit, auto transceiver unit and home receiver unit, all connected wirelessly to each other by uniquely coded radio frequency signal, comprising the steps of:

A user, typically a real estate agent, depressing a panic button on said personal transmitter unit carried on her person;

Said transmitter unit sounding an alarm integrally contained within said transmitter unit, and also transmitting a first radio frequency signal carrying a unique rolling code;

Said first radio frequency signal with unique rolling code being received by said auto transceiver unit, and said auto transceiver unit responsively transmitting a radio frequency signal carrying a system standard code;

Said radio frequency signal with said system standard code being received by said home receiver unit attuned thereto and thereby activating an integral alarm of said receiver unit wherein said home receiver unit further comprises a remote indicator light and a local/remote mode switch capable of setting the receiver unit either local mode or remote mode, wherein said home receiver unit is set in local mode and said integral alarm of said home receiver will be activated only upon receipt either one of the standard system coded radio frequency signals, and wherein said home receiver unit is set in remote mode and said integral alarm of said home receiver unit will be activated only upon receipt of both standard system coded radio frequency signal from the transmitter unit and the transceiver unit.

10. The personal alarm system of claim 9 wherein said personal transmitter unit further comprises a built-in flashlight with flash button.

11. The personal alarm system of claim 9 wherein said personal transmitter unit further comprises a cancel button for deactivating the alarm once sounded.

12. The personal alarm system of claim 9 wherein a deactivation code of said personal transmitter can be set by the user with said cancel button in combination with other available buttons.

13. The personal alarm system of claim 9 wherein said auto transceiver unit further comprises an antenna capable of extending the receive range of said transceiver.

14. The personal alarm system of claim 9 wherein said transmitter unit also transmits a second radio frequency signal carrying said standard system code.

15. The personal alarm system of claim 9 wherein said transceiver unit further comprises a learn button with software for recognizing the unique rolling code of the radio frequency signal transmitting from the transmitter unit.

* * * * *